US007043919B1

(12) United States Patent
Kalina

(10) Patent No.: US 7,043,919 B1
(45) Date of Patent: May 16, 2006

(54) MODULAR CONDENSATION AND THERMAL COMPRESSION SUBSYSTEM FOR POWER SYSTEMS UTILIZING MULTI-COMPONENT WORKING FLUIDS

(75) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 0 days.

(21) Appl. No.: 10/984,021

(22) Filed: Nov. 8, 2004

(51) Int. Cl.
*F01K 25/08* (2006.01)

(52) U.S. Cl. ..... 60/651; 60/653; 60/671

(58) Field of Classification Search ..... 60/649, 60/651, 653, 670, 671
See application file for complete search history.

(56) References Cited

U.S. PATENT DOCUMENTS

| | | | | |
|---|---|---|---|---|
| 4,819,437 | A * | 4/1989 | Dayan | 60/673 |
| 6,058,695 | A * | 5/2000 | Ranasinghe et al. | 60/39.182 |
| 6,195,998 | B1 * | 3/2001 | Hansen et al. | 60/649 |
| 6,223,535 | B1 * | 5/2001 | Kitz | 60/641.2 |
| 6,735,948 | B1 * | 5/2004 | Kalina | 60/649 |
| 6,829,895 | B1 * | 12/2004 | Kalina | 60/649 |

* cited by examiner

*Primary Examiner*—Hoang Nguyen
(74) *Attorney, Agent, or Firm*—Robert W. Strozier

(57) ABSTRACT

New more efficient condensation and thermal compression subsystems for power plants utilizing multi-component fluids are disclosed that simplify the equipment needed to improve the overall efficiency and efficiency of the condensation and thermal compress subsystem.

21 Claims, 10 Drawing Sheets

MODULAR CONDENSATION AND THERMAL COMPRESSION SUBSYSTEM FOR POWER SYSTEMS UTILIZING MULTI-COMPONENT WORKING FLUIDS

BACKGROUND OF THE INVENTION

1. Field of the Invention

The present invention relates to a modular condensation and thermal compression apparatus for use in power extraction systems.

More particularly, the present invention relates to a modular condensation and thermal compression apparatus for use in power extraction systems, where the modular apparatus or subsystem includes a plurality of heat exchangers, a plurality of pumps, a plurality of throttle control valves, and at least one separator, where the apparatus is designed to efficiently condense and thermally compress an in-coming, low pressure, multi-component working fluid to produce a high pressure, out-going, liquid, multi-component working fluid and where a composition of the in-coming fluid is the same as a composition of the out-going fluid. The present invention also relates to a method where an in-coming, low pressure, vapor multi-component working fluid is converted into a high pressure, out-going, liquid multi-component working fluid in a modular condensation and thermal system.

2. Description of the Related Art

Power systems with thermodynamical power cycles utilizing multi-component working fluids can attain a higher efficiency than power systems utilizing single-component working fluids. Multi-component working fluids condense at variable temperatures. Such working fluids, unlike single component working fluids, have a thermodynamical potential to perform useful work even when sent into a condenser after expansion in a turbine.

Therefore, in the prior art, several power systems that utilized a multi-component working fluid, were designed to have condensation occur in special subsystems which were referred to as distillation condensation subsystems. In this application, such a subsystems will be referred to as a Condensation and Thermal Compression Subsystems (CTCSS), a term that more accurately describes the nature of such subsystems. Such subsystems all work on the following principle: A stream of working fluid subject to condensation enters into the CTCSS at a pressure which is substantially lower than the pressure required for the complete condensation of such a stream at a given ambient temperature. The stream of working fluid is mixed with a recirculating stream of lean solution (i.e., a stream with a substantially lower concentration of the low-boiling component), forming a new stream which can be fully condensed at the given ambient temperature, (referred to as the "basic solution"). Thereafter, the basic solution stream is pumped to a pressure which is slightly higher than the pressure required for the condensation of the working fluid, and is subjected to partial re-vaporization, for which heat that was released in the process of condensation is utilized. Then, the partially vaporized basic solution stream is separated into a lean liquid stream having a reduced concentration of the low-boiling component and a rich vapor stream having a higher concentration of the low-boiling component. The lean liquid stream is then mixed with the condensing stream of working solution (as described above), while the rich vapor stream is combined with a portion of the basic solution stream to reconstitute the initial composition of the working fluid, which is then fully condensed.

In U.S. Pat. No. 4,489,563, the most basic and elementary CTCSS has been described. In this very simple CTCSS, heat from rich vapor stream and lean liquid stream produced by partial re-vaporization is not recuperated, drastically reducing the efficiency of this simple CTCSS.

In other prior art including U.S. Pat. Nos.: 4,548,043; 4,586,340; 4,604,867; 4,763,480; 5,095,708; and 5,572,871, more complicated and elaborate CTCSSs were disclosed. However, all of these prior art CTCSS have one common drawback. In order to increase efficiency via better heat recuperation, they require multiple separate heat exchangers. In many cases, the complexity and high price of such CTCSS are not justified by the increased efficiency that the CTCSS provides.

Thus, there is a need in the art for a Condensation and Thermal Compression Subsystem (CTCSS) that has improved efficiency off-setting the additional cost.

SUMMARY OF THE INVENTION

The present invention provides a system including a plurality of heat exchangers, a plurality of pumps, a plurality of throttle valves and at least one separator, where the system efficiently converts an in-coming, low pressure, multi-component working fluid stream into a high pressure, out-going, liquid multi-component working fluid stream. The system is ideally suited for condensation of a spent vapor multi-component working fluid stream derived from an energy extraction system or turbine system such as the extraction systems described in United States patent and Pending patent application Nos.

The present invention also provides a minimally configured CTCSS system including five heat exchangers, one separator, two pumps, two throttle control valves, two mixing valves, three splitter valves. The CTCSS is supplied an incoming vapor multi-component working fluid stream which is then made lean via the addition of two lean liquid multi-component streams to form a partially condensed basic solution stream. The partially condensed basic solution stream is then fully condensed in one of the five heat exchangers using an external coolant. The fully condensed basic solution stream is then pressurized and split into two substreams. Heat is transferred from the lean streams to one of the pressurized basic solution streams, which is then separated into a rich vapor stream and the two lean liquid streams in three of the five heat exchangers. The rich vapor stream and the other pressurized basic solution stream is mixed to form a partially condensed outgoing multi-component stream, which is fully condensed in one of the five heat exchangers via a coolant stream and then pressurized to a desired high pressure to form a liquid, high pressure multi-component working fluid stream adapted for vaporization by an external heat source and energy extraction to generate electricity.

The present invention provides a method condensing and thermally compressing a spent vapor, multi-component working fluid stream including the steps of forming a plurality of lean streams form the spent vapor, multi-component working fluid stream and transferring thermal energy from the plurality of lean streams to a basic solution stream to form a partially liquified, lower pressure basic solution stream. The partially condensed, lower pressure basic solution stream is then fully condensed with an external coolant stream. The fully condensed lower pressure basic solution stream is then pumped to a higher pressure and split into a first and second higher pressure basic solution substream. The first higher pressure basic solution substream absorbs the thermal energy from the plurality of lean streams. The heated first higher pressure, basic solution substream is then separated into a rich vapor stream and a lean liquid stream. The lean liquid stream is split into two lean liquid substreams. The first lean liquid substream is combined with the spent vapor, multi-component working fluid stream to form a first lean stream which transfers a portion of its thermal energy to the first higher pressure basic solution stream. The second lean liquid substream is mixed with the cooled spent, vapor multi-component working fluid stream to form a second lean stream, which is further cooled by transferring its thermal energy to the first higher pressure, basic solution stream to the partially liquified, lower pressure basic solution stream. The second higher pressure, basic solution stream is mixed with the rich vapor stream to form a liquid multi-component working fluid stream, which is fully condensed by a second coolant stream and pressurized to a desire higher pressure to form a high pressure, liquid multi-component working fluid stream.

The present invention provides a method for converting thermal energy into mechanical and/or electrical energy including the steps of condensing a spent multi-component fluid stream to form a liquid multi-component fluid stream, vaporizing the liquid multi-component fluid stream to form a fully vaporized multi-component fluid stream and extracting energy from the fully vaporized multi-component fluid stream to form the spent multi-component fluid stream.

The present invention provides a condensation and thermal compression system including: (1) a separation subsystem comprising a separator adapted to produce a rich vapor stream and a lean liquid stream; (2) a heat exchange subsystem comprising three heat exchangers and two throttle control valves; (3) a first condensing and pressurizing subsystem comprising a first condenser and a first pump; and (4) a second condensing and pressurizing subsystem comprising a second condenser and a second pump. The heat exchange subsystem is adapted to mix a pressure adjusted first portion of the lean liquid stream with an incoming stream to form a pre-basic solution stream, to mix a pressure adjusted second portion of the lean liquid stream with the pre-basic solution stream to form a basic solution stream, to bring a first portion of a pressurized fully condensed basic solution stream into a heat exchange relationship with the pre-basic solution stream to form a partially condensed basic solution stream. The first condensing and pressurizing subsystem is adapted to fully condense the partially condensed basic solution stream to form a fully condensed basic solution stream and to pressurize the fully condensed basic solution stream to form a pressurized fully condensed working fluid stream. The second condensing and pressurizing subsystem is adapted to mix a second portion of the fully condensed basic solution stream and the rich vapor stream to form an outgoing stream, to fully condense the outgoing stream and to pressurize the outgoing stream to a desired high pressure. The first portion of the lean liquid stream is pressure adjusted to have the same or substantially the same pressure as the incoming stream and where the second portion of the lean stream is pressure adjusted to have the same or substantially the same pressure as the pre-basic solution stream and where the streams comprise at least one lower boiling component and at least one higher boiling component and the compositions of the streams are the same or different with the composition of the incoming stream and the outgoing stream being the same. The second condensing and pressurizing subsystem can further comprise a heat exchanger adapted to cool the rich vapor stream and heating the high pressure outgoing working fluid stream.

The present invention also provides a condensation and thermal compression system including: (1) a separation subsystem comprising two separators and one scrubber adapted to produce three rich vapor streams and three lean liquid stream and to forward the first rich vapor stream from the first separator to the scrubber; (2) a heat exchange subsystem comprising three heat exchangers and five throttle control valves; (3) a first condensing and pressurizing subsystem comprising a first condenser and three pumps; and (4) a second condensing and pressurizing subsystem comprising a second condenser and a fourth pump adapted to fully condense the partially condensed outgoing stream in the second condenser using a second external coolant stream to form a fully condensed outgoing stream and to pressurize the fully condensed outgoing stream to a desired high pressure to form an outgoing stream. The heat exchange subsystem is adapted: (1) to mix an incoming stream and a pressure adjusted, first portion of a first lean liquid stream from the first separator through the first throttle control valve to form a lean mixed stream, (2) to bring into a heat exchange relationship a heated first portion of a first pressurized basic solution substream and the lean mixed stream in a first heat exchanger to form a cooled lean mixed stream and a partially vaporized, pressurized basic solution stream, (3) to forward the partially vaporized, pressurized basic solution stream to the first separator, (4) to mix the cooled lean mixed stream and a pressure adjusted, second portion of the first lean liquid stream from the first separator through the second throttle control valve and a pressure adjusted, second lean liquid stream from the scrubber through the third throttle control valve to form a pre-basic solution stream, (5) to bring into a heat exchange relationship the pre-basic solution stream and a pre-heated, first portion of the first pressurized basic solution substream in the second heat exchanger to form a cooled pre-basic solution stream and the heated first portion of the first pressurized basic solution substream, (6) to forward a second portion of the pre-heated first pressurized basic solution substream to the scrubber, (7) to forward a third portion of the pre-heated first pressurized basic solution substream to the second separator through the fourth throttle control valve, (8) to bring into a heat exchange relationship the cooled pre-basic solution stream and the first pressurized basic solution substream in a third heat exchanger to form a cooler pre-basic solution stream and the pre-heated first pressurized basic solution substream, and (9) to mix the cooler pre-basic solution stream and a pressure adjusted third lean liquid stream from the second separation through the fifth throttle control valve to form a partially condensed basic solution stream. The first condensing and pressurizing subsystem is adapted: (1) to fully condense the partially condensed basic solution stream in the first condenser using a first external coolant stream to form a fully condensed basic solution stream; (2) to split the fully condensed basic solution stream into a first fully condensed basic solution substream and a second fully condensed basic solution substream; (3) to pressurize the first fully condensed basic solution substream through the first pump to form the first pressurized fully condensed basic solution substream; (4) to pressurize the second fully condensed basic solution substream through the second pump to form a second pressurized fully condensed basic solution substream; (5) to mix the second pressurized fully condensed basic solution substream and the second rich vapor stream from the second separator to form a pre-outgoing stream; (6) to pressurize the pre-outgoing stream in the third pump to form a pressurized pre-outgoing stream; and (7) to mix the pressurized pre-outgoing stream with the third rich vapor stream from the scrubber to form a partially condensed outgoing stream. The streams comprise at least one lower boiling component and at least one higher boiling component and the compositions of the streams are the same or different with the composition of the incoming stream and the outgoing stream being the same. The second condensing and pressurizing subsystem can further comprise a fourth heat exchanger adapted to bring the third rich vapor stream and the outgoing stream heating the outgoing stream to a desired higher temperature.

The first condensing and pressurizing subsystem can further comprise a third condenser adapted to fully condense a pre-outgoing stream in the third condenser using a third external coolant stream to form a fully condensed, pre-outgoing stream prior to being pressurized in the third pump and mixed with the third rich vapor stream to form the partially condensed outgoing stream. With the modification to the first condensing and pressurizing subsystem, the second condensing and pressurizing subsystem further comprising a fourth heat exchanger adapted to bring the third rich vapor stream and the outgoing stream heating the outgoing stream to a desired higher temperature.

The heat exchange subsystem can further comprise a fifth heat exchanger adapted to bring into a heat exchange relationship the first portion of the first lean liquid stream from the first separator and an external heat carrier stream to from a heated first portion of the first lean liquid stream prior to passing through the first throttle control valve and being mixed with the incoming stream. With this modification to the heat exchange subsystem the second condensing and pressurizing subsystem further comprising a fourth heat exchanger adapted to bring the third rich vapor stream and the outgoing stream heating the outgoing stream to a desired higher temperature. With this modification to the heat exchange subsystem, the first condensing and pressurizing subsystem further comprising a third condenser adapted to fully condense a pre-outgoing stream in the third condenser using a third external coolant stream to form a fully condensed, pre-outgoing stream prior to being pressurized in the third pump and mixed with the third rich vapor stream to form the partially condensed outgoing stream. With this modification to the first condensing and pressurizing subsystem, the second condensing and pressurizing subsystem further comprising a fourth heat exchanger adapted to bring the third rich vapor stream and the outgoing stream heating the outgoing stream to a desired higher temperature.

The present invention provides a method including mixing an incoming stream and a pressure adjusted first portion of a lean liquid stream to form a pre-basic solution stream. The pre-basic solution stream is then brought into a heat exchange relationship with a first portion of a heated, pressurized basic solution stream to form a cooled pre-basic solution stream and a partially vaporized basic solution stream. The cooled pre-basic solution stream and a pressure adjusted second portion of the lean liquid stream are mixed to form a basic solution stream. The basic solution stream is brought into a heat exchange relationship with the first portion of a pressurized fully condensed basic solution stream to form a partially condensed basic solution stream and the heated, pressurized basic solution stream. The partially condensed basic solution stream is condensed using an external coolant stream to from a fully condensed basic solution stream. The fully condensed basic solution stream is pressurized to form the pressurized fully condensed basic solution stream. The partially vaporized basic solution stream is separated into a rich vapor stream and the lean liquid stream. The vapor steam and a second portion of the pressurized fully condensed basic solution stream are mixed to form a pre-outgoing stream. The pre-outgoing stream using a second external coolant stream is condensed to form a fully condensed, pre-outgoing stream. The fully condensed, pre-outgoing stream is pressurized to a desired high pressure to form an outgoing stream. The streams comprise at least one lower boiling component and at least one higher boiling component and the compositions of the streams are the same or different with the composition of the incoming stream and the outgoing stream being the same. The second bringing step includes a first heat exchange step where the basic solution stream is brought into heat exchange relationship with a partially heated pressurized basic solution stream to form a pre-partially condensed basic solution stream and the heated, pressurized basic solution stream, and a second heat exchange step where the pre-partially condensed basic solution stream is brought into heat exchange relationship with the first portion of the pressurized basic solution stream to from the partially condensed basic solution stream and a pre-heated, pressurized basic solution stream.

The present invention also provides a method including mixing an incoming stream and a pressure adjusted, first portion of a first lean liquid stream to form a lean mixed stream. A heated first portion of a first pressurized basic solution substream and the lean mixed stream are brought into a heat exchange relationship to form a cooled lean mixed stream and a partially vaporized, pressurized basic solution stream. The partially vaporized, pressurized basic solution stream is forwarded to the first separator. The cooled lean mixed stream and a pressure adjusted, second portion of the first lean liquid stream from the first separator through the second throttle control valve and a pressure adjusted, second lean liquid stream from the scrubber through the third throttle control valve are mixed to form a pre-basic solution stream. The pre-basic solution stream and a pre-heated, first portion of the first pressurized basic solution substream are brought into a heat exchange relationship to form a cooled pre-basic solution stream and the heated first portion of the first pressurized basic solution substream. A second portion of the pre-heated first pressurized basic solution substream is forwarded to the scrubber. A third portion of the pre-heated first pressurized basic solution substream is forwarded to the second separator through the fourth throttle control valve. The cooled pre-basic solution stream and the first pressurized basic solution substream are brought into a heat exchange relationship in a third heat exchanger to form a cooler pre-basic solution stream and the pre-heated first pressurized basic solution substream. The cooler pre-basic solution stream and a pressure adjusted third lean liquid stream from the second separation through the fifth throttle control valve are mixed to form a partially condensed basic solution stream. The partially condensed basic solution stream in the first condenser using a first external coolant stream is fully condensed to form a fully condensed basic solution stream. The fully condensed basic solution stream is split into a first fully condensed basic solution substream and a second fully condensed basic solution substream. The first fully condensed basic solution substream through the first pump is pressurized to form the first pressurized fully condensed basic solution substream. The second fully condensed basic solution substream through the second pump is pressurized to form a second pressurized fully condensed basic solution substream. The second pressurized fully condensed basic solution substream and the second rich vapor stream from the second separator are mixed to form a pre-outgoing stream. The pre-outgoing stream in the third pump is pressurized to form a pressurized pre-outgoing stream. The pressurized pre-outgoing stream and the third rich vapor stream from the scrubber are mixed to form a partially condensed outgoing stream. The partially condensed outgoing stream is fully condensed in the second condenser using a second external coolant stream to form a fully condensed outgoing stream. The fully condensed outgoing stream is pressurized to a desired high pressure to form an outgoing stream. The streams comprise at least one lower boiling component and at least one higher boiling component and the compositions of the streams are the same or different with the composition of the incoming stream and the outgoing stream being the same.

The present invention includes a power generation system including a modular condensation and thermal compression subsystem of this invention, a vaporization subsystem and an energy extraction subsystem.

The present invention method includes a step of condensing a spent working fluid stream from an energy extraction subsystem to form a fully condensed working fluid stream, vaporizing the fully condensed working fluid stream using an external heat source stream to form a fully vaporizing working fluid stream, converting the thermal energy in the vaporized working fluid stream to a useable form of energy and repeating the cycle.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
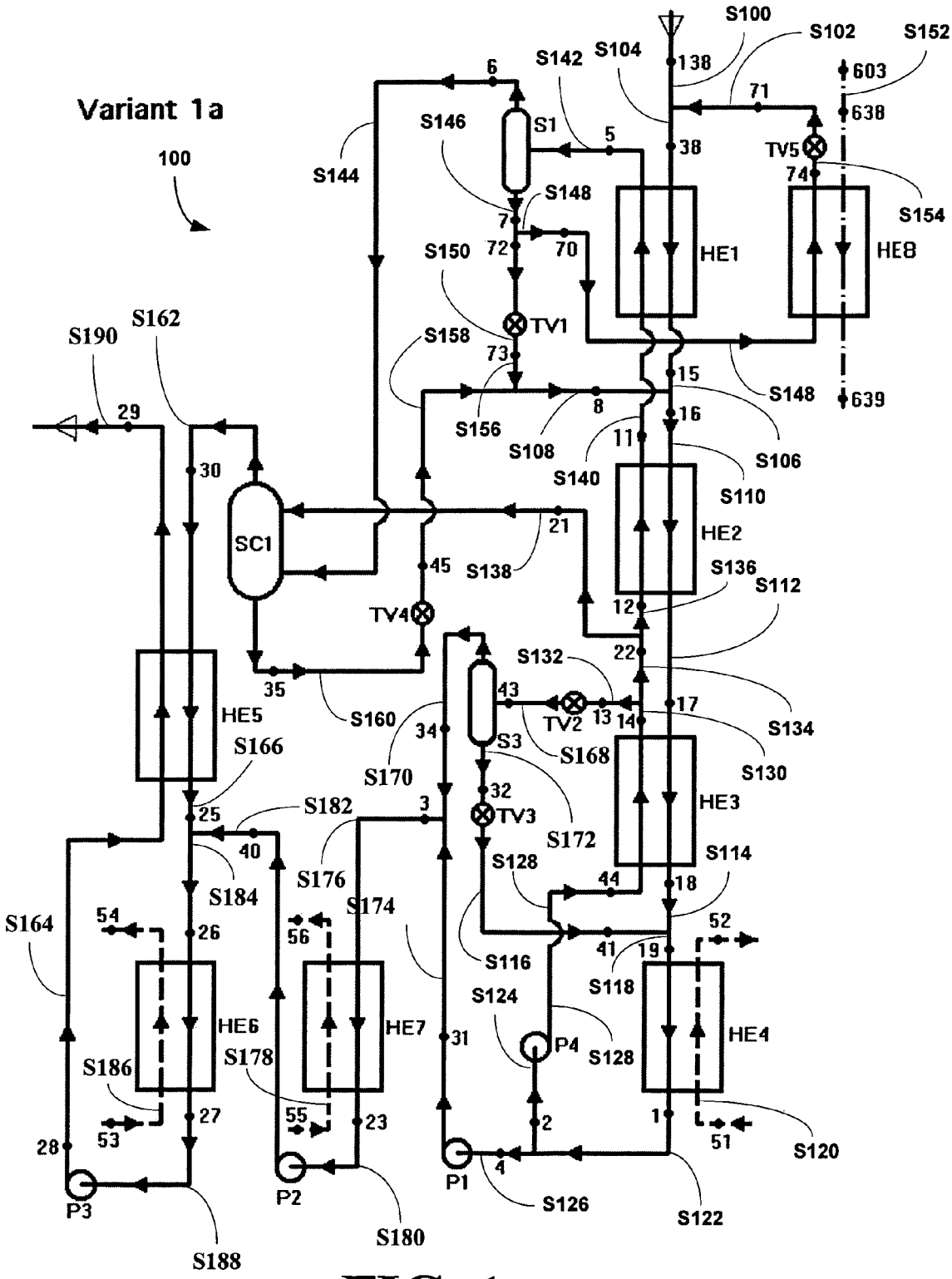
FIG. 1 depicts a block diagram of a preferred embodiment of Variant 1*a* of a condensation and thermal compression subsystems.

The inventors has found that Condensation and Thermal Compression Subsystems (CTCSS) having an effective increase in efficiency that fully justifies the cost in terms of complexity and price of the proposed CTCSS can be realized for a wide variety of power producing plants. The inventor has designed the system of this invention to be modular, which allows one skilled in the art to choose to exclude specific modular components, simplifying the final system, and thus optimizing the system in term of efficiency, cost and complexity for each individual power system being designed.

In many systems, apart from the heat potential of the condensing stream of working fluid, additional, external low-temperature heat is available. Such heat, which cannot be utilized directly in a power system, can be utilized by the proposed CTCSS of this invention, thus increasing the CTCSS efficacy. Preferred embodiments of the system of this invention, therefore, incorporate the optional use of such external heat to further enhance CTCSS efficiency.

The present invention broadly relates to a Condensation and Thermal Compression Subsystems (CTCSS) including a plurality of heat exchanger, a plurality of pumps, a plurality of throttle control valves, a plurality of mixing valves and splitter valves, one or two separators, and an optional scrubber. In a minimal preferred embodiment, the CTCSS includes five heat exchangers, two pumps, two throttle control valves, three mixing valve, two splitter valves, and a separator. In a maximal preferred embodiment, the CTCSS includes eight heat exchangers, four pumps, five throttle control valves, two separators, and a scrubber.

The present invention broadly relates to system including a Condensation and Thermal Compression Subsystems (CTCSS) of this invention, a multi-component vaporizing subsystem and an energy extraction subsystem.

The present invention broadly relates to a method for condensation and thermal compression including the steps of supplying an incoming low pressure, vapor multi-component working fluid stream from an energy extraction subsystem. The incoming vapor multi-component working fluid stream is then made lean via the addition of a plurality of lean liquid multi-component streams to form a pre-basic solution stream and finally a partially condensed basic solution stream. The partially condensed basic solution stream is fully condensed using an external coolant in a first heat exchange process. The fully condensed basic solution stream is then pressurized and split into two substreams. Heat is transferred from the pre-basic solution and basic solution to one of the pressurized basic solution substreams in a plurality of heat exchange processes. The heated and pressurized basic solution substream is then separated into a rich vapor stream and the plurality of lean liquid streams. The rich vapor stream and the other pressurized basic solution stream is mixed to form a partially condensed outgoing multi-component stream, which is then fully condensed in another heat exchange process via a coolant stream and then pressurized to a desired high pressure to form a liquid, high pressure multi-component working fluid stream adapted for vaporization by an external heat source and energy extraction to generate electricity.

The present invention broadly relates to a method for power extraction including the steps condensing a spent multi-component fluid stream to form a liquid multi-component fluid stream, vaporizing the liquid multi-component fluid stream to form a fully vaporized multi-component fluid stream and extracting energy from the fully vaporized multi-component fluid stream to form the spent multi-component fluid stream.

The working fluid used in the systems of this inventions is a multi-component fluid that comprises a lower boiling point material—the low boiling component—and a higher boiling point material—the high boiling component. Preferred working fluids include, without limitation, an ammonia-water mixture, a mixture of two or more hydrocarbons, a mixture of two or more freons, a mixture of hydrocarbons and freons, or the like. In general, the fluid can comprise mixtures of any number of compounds with favorable thermodynamic characteristics and solubilities. In a particularly preferred embodiment, the fluid comprises a mixture of water and ammonia.

The present invention also includes piping interconnecting the components that make up the systems and includes mixing valves that combine two or more streams into a single stream and splitting valves that divide a single stream into two or more streams. These valves are generally a function of the exact CTCSS being designed and one of ordinary skill in the art will know the criteria of each valve for a given CTCSS configuration.

CTCSS Variant 1*a*

Referring now to FIG. 1, a preferred embodiment of a CTCSS of this invention, generally 100, is shown and is referred to herein as Variant 1*a*. Variant 1*a* represents a very comprehensive variant of the CTCSSs of this invention.

The operation of Variant 1*a* of the CTCSS of this invention is now described.

A stream S100 having parameters as at a point 138, which can be in a state of superheated vapor or in a state of saturated or slightly wet vapor, enters into the CTCSS 100. The stream S100 having the parameters as at the point 138 is mixed with a first mixed stream S102 having parameters as at a point 71, which is in a state of a liquid-vapor mixture (as describe more fully herein), forming a first combined stream S104 having parameters as at a point 38. If the stream S100 having the parameters as at the point 138 is in a state of saturated vapor, then a temperature of the stream S102 having the parameters as at the point 71 must be chosen in such a way as to correspond to a state of saturated vapor. As a result, the stream S104 having the parameters as at the point 38 will be in a state of a slightly wet vapor. Alternatively, if the stream S100 having the parameters as at the point 138 is in a state of superheated vapor, then stream S102 having the parameters of at the point 71 must be chosen in such a way that the resulting stream S104 having the parameters as at a point 38 should be in, or close to, a state of saturated vapor, where close to means the state of the vapor is within 5% of the saturated vapor state for the vapor. In all cases, the parameters of the stream S102 at the point 71 are chosen in such a way as to maximize a temperature of the stream S104 at the point 38.

Thereafter, the stream S104 having the parameters as at the point 38 passes through a first heat exchanger HE1, where it is cooled and partially condensed and releases heat in a first heat exchange process, producing a second mixed stream S106 having parameters as at a point 15. The stream S106 having the parameters as at the point 15 is then mixed with a stream S108 having parameters as at a point 8, forming a stream S110 having parameters as at a point 16. In the preferred embodiment of this system, the temperatures of the streams S108, S106 and S110 having parameters of the points 8, 15, and 16, respectively, are equal or very close, within about 5%. A concentration of the low-boiling component in stream S108 having the parameters as at the point 8 is substantially lower than a concentration of the low boiling component in the stream S106 having the parameters as at the point 15. As a result, a concentration of the low boiling component in the stream S110 having the parameters as at the point 16 is lower than the concentration of the low boiling component of the stream S106 having the parameters as at the point 15, i.e., stream S110 having the parameters as at the point 16 is leaner than stream S106 having the parameters as at the point 15.

The stream S110 having the parameters as at the point 16 then passes through a second heat exchanger HE2, where it is further condensed and releasing heat in a second heat exchange process, forming a stream S112 having parameters as at a point 17. The stream S112 having the parameters as at the point 17 then passes through a third heat exchanger HE3, where it is further condensed in a third heat exchange process to form a stream S114 having parameters as at a point 18. At the point 18, the stream S114 is partially condensed, but its composition, while substantially leaner that the compositions of the stream S100 and S104 having the parameters as at the points 138 and 38, is such that it cannot be fully condensed at ambient temperature. The stream S114 having the parameters as at the point 18 is then mixed with a stream S116 having parameters as at a point 41, forming a stream S118 having parameters as at a point 19. The composition of the stream S118 having the parameters as at the point 19 is such that it can be fully condensed at ambient temperature.

The stream S118 having the parameters as at the point 19 then passes through a low pressure condenser HE4, where it is cooled in a fourth heat exchange process in counterflow with a stream S120 of cooling water or cooling air having initial parameters as at a point 51 and final parameters as at a point 52, becoming fully condensed, to form a stream S122 having parameters as at a point 1. The composition of the stream S122 having the parameters as at the point 1, referred to herein as the "basic solution," is substantially leaner than the composition of the stream S100 having the parameters at the point 138, which entered the CTCSS 100. Therefore, the stream S122 having the parameters as at the point 1 must be distilled at an elevated pressure in order to produce a stream having the same composition as at point 138, but at an elevated pressure that will allow the stream to fully condense.

The stream S122 having the parameters as at the point 1 is then divided into two substreams S124 and S126 having parameters as at points 2 and 4, respectively. The stream S124 having the parameters as at the point 2 enters into a circulating fourth pump P4, where it is pumped to an elevated pressure forming a stream S128 having parameters as at a point 44, which correspond to a state of subcooled liquid. Thereafter, the stream S128 having the parameters as at the point 44 passes through a third heat exchanger HE3 in counterflow with the stream S112 having the parameters as at the point 17 in a third heat exchange process as described above, is heated forming a stream S130 having parameters as at a point 14. The stream S130 having the parameters as at the point 14 is in, or close to, a state of saturated liquid. Again, the term close to means that the state of the stream S130 is within 5% of being a saturated liquid. Thereafter, the stream S130 having parameters as at point 14 is divided into two substreams S132 and S134 having parameters as at points 13 and 22, respectively. The stream S134 having the parameters as at the point 22 is then divided into two substreams S136 and S138 having parameters as at points 12 and 21, respectively. The stream S136 having the parameters as at the point 12 then passes through the second heat exchanger HE2, where it is heated and partially vaporized in counterflow to the stream S100 having the parameters as at the point 16 as described above in a second heat exchange process, forming a stream S140 having parameters as at a point 11. The stream S140 having the parameters as at the point 11 then passes through the first heat exchanger HE1, where it is further heated and vaporized in counterflow to the stream S104 having stream 38 as described above in a first heat exchange process, forming a stream S142 having parameters as at a point 5.

The stream S142 having the parameters as at the point 5, which is in a state of a vapor-liquid mixture, enters into a first separator S1, where it is separated into a saturated vapor stream S144 having parameters as at a point 6 and saturated liquid stream S146 having parameters as at a point 7.

The liquid stream S146 having the parameters as at the point 7 is divided into two substreams S148 and S150 having parameters as at points 70 and 72, respectively. The stream S148 having the parameters as at the point 70, then passes through an eighth heat exchanger HE8, where it is heated and partially vaporized in an eighth heat exchange process, in counterflow to an external heat carrier stream S152 having initial parameters as a point 638 and final parameters as at a pint 639, forming a stream S154 having parameters as at a point 74. Thereafter, stream S154 having the parameters as at the point 74 passes through a fifth throttle valve TV5, where its pressure is reduced to a pressure equal to a pressure of the stream S100 having the parameters as at the point 138, forming the stream S102 having the parameters as at the point 71. Thereafter, the stream S102 having the parameters as at the point 71 is mixed with the stream S100 having the parameters as at the point 138, forming the stream S104 having the parameters as at the point 38 as previously described.

The stream S150 having parameters as at point 72, then passes through a first throttle valve TV1, where its pressure is reduced, forming a stream S156 having parameters as at a point 73. The pressure of the stream S156 having the parameters as at the point 73 is equal to a pressure of the streams S106, S108, and S110 having the parameters as at the points 15, 8 and 16. Thereafter the stream S156 having the parameters as at the point 73 is mixed with a stream S158 having parameters as at a point 45, forming the stream S108 having the parameters as at the point 8. The stream S108 having the parameters as a the point 8 is then mixed with the stream S106 having the parameters as at the point 15, forming the stream S110 having the parameters as at the point 16 as described above.

Meanwhile, the vapor stream S144 having the parameters as at the point 6 is sent into a bottom part of a first scrubber SC1, which is in essence a direct contact heat and mass exchanger. At the same time, the stream S138 having the parameters as at the point 21 as described above, is sent into a top portion of the first scrubber SC1. As a result of heat and mass transfer in the first scrubber SC1, a liquid stream S160 having parameters as at a point 35, which is in a state close to equilibrium (close means within about 5% of the parameters of the stream S144) with the vapor stream S144 having the parameters as at the point 6, is produced and removed from a bottom of the first scrubber SC1. At the same time, a vapor stream S162 having parameters as at point 30, which is in a state close to equilibrium with the liquid stream S138 having the parameters as at the point 21, exits from a top of the scrubber SC1.

The vapor stream S162 having the parameters as at the point 30 is then sent into a fifth heat exchanger HE5, where it is cooled and partially condensed, in counterflow with a stream S164 of working fluid having parameters as at a point 28 in a fifth heat exchange process, forming a stream S166 having parameters as at a point 25.

The liquid stream S160 having the parameters as at the point 35 is removed from the bottom of the scrubber SC1 and is sent through a fourth throttle valve TV4, where its pressure is reduced to a pressure equal to the pressure of the stream S156 having the parameters as at the point 73, forming the stream S158 having the parameters as at the point 45. The stream S158 having the parameters as at the point 45 is then mixed with the stream S156 having the parameters as at the point 73, forming the stream S108 having the parameters as at the point 8 as described above.

The liquid stream S132 having the parameters as at the point 13, which has been preheated in the third heat exchanger HE3 as described above, passes through a second throttle valve TV2, where its pressure is reduced to an intermediate pressure, (i.e., a pressure which is lower than the pressure of the stream S130 having the parameter as at the point 14, but higher than the pressure of the stream S122 having the parameters as at the point 1), forming a stream S168 parameters as at a point 43, corresponding to a state of a vapor-liquid mixture. Thereafter, the stream S168 having the parameters as at the point 43 is sent into a third separator S3, where it is separated into a vapor stream S170 having parameters as at a point 34 and a liquid stream S172 having parameters as at a point 32.

A concentration of the low boiling component in the vapor stream S170 having the parameters as at the point 34 is substantially higher than a concentration of the low boiling component in the stream S100 having the parameters as at the point 138 as it enters the CTCSS 100 as described above. The liquid stream S172 having the parameters as at the point 32 has a concentration of low boiling component which is less than a concentration of low boiling component in the stream S122 having the parameters as at the point 1 as described above.

The liquid stream S126 of the basic solution having the parameters as at the point 4 as described above, enters into a first circulating pump P1, where it is pumped to a pressure equal to the pressure of the stream S170 having the parameters as at the point 34, forming a stream S174 having parameters as at a point 31 corresponding to a state of subcooled liquid. Thereafter, the subcooled liquid stream S174 having the parameters as at the point 31 and the saturated vapor stream S170 having the parameters as at the point 34 are combined, forming a stream S176 having parameters as at a point 3. The stream S176 having the parameters as at the point 3 is then sent into an intermediate pressure condenser or a seventh heat exchanger HE7, where it is cooled and fully condensed in a seventh heat exchange process, in counterflow with a stream S178 of cooling water or air having initial parameters as at a point 55 and having final parameters as at a point 56, forming a stream S180 having parameters as at a point 23. The stream S180 having parameters as at point 23 then enters into a second circulating pump P2, where its pressure is increased to a pressure equal to that of the stream S166 having the parameters as at the point 25 as described above, forming a stream S182 parameters as at a point 40. The stream S182 having the parameters as at the point 40 is then mixed with the stream S166 having the parameters as at the point 25 as described above, forming a stream S184 having parameters as at a point 26. The composition and flow rate of the stream S182 having the parameters as at the point 40 are such that the stream S184 having the parameters as at the point 26 has the same composition and flow rate as the stream S100 having the parameters as at the point 138, which entered the CTCSS 100, but has a substantially higher pressure.

Thereafter, the stream S184 having the parameters as at the point 26 enters into a high pressure condenser or sixth heat exchanger HE6, where it is cooled and fully condensed in a sixth heat exchange process, in counterflow with a stream S186 of cooling water or air having initial parameters as at a point 53 and final parameters as at a point 54, forming a steam S188 parameters as at a point 27, corresponding to a state of saturated liquid. The stream S188 having the parameters as at the point 27 then enters into a third or feed pump P3, where it is pumped to a desired high pressure, forming the stream S164 having the parameters as at the point 28. Then the stream S164 of working fluid having the parameters as at the point 28 is sent through the fifth heat exchanger HE5, where it is heated, in counterflow with the stream S162 having the parameters as at the point 30 in the fifth heat exchange process, forming a stream S190 having parameters as at a point 29 as described above. The stream S190 having the parameters as at a point 29 then exits the CTCSS 100, and returns to the power system. This CTCSS of this invention is closed in that no material is added to any stream in the CTCSS.

Figure 2:
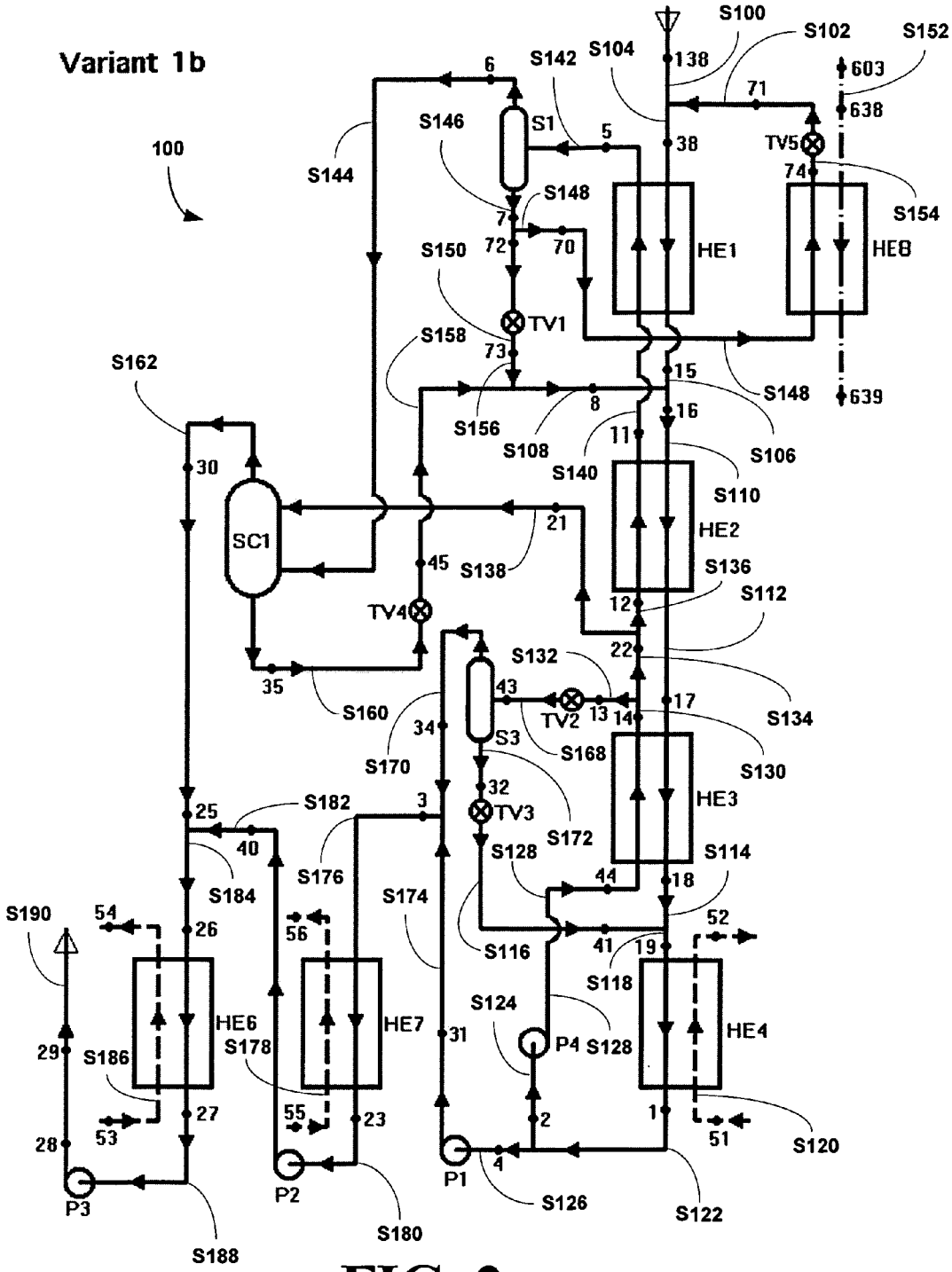
FIG. 2 depicts a block diagram of another preferred embodiment of Variant 1*b* of a condensation and thermal compression subsystems.

In some cases, preheating of the working fluid which is reproduced in the CTCSS is not necessary. In such cases, the fifth heat exchanger HE5 is excluded from the Variant 1*a* described above. As a result, the stream S162 having the parameters as at the point 30 and the stream S166 having the parameters as at the point 25 are the same, and the stream S164 having the parameters at the point 28 are the stream S190 having the parameters as at the point 29 are the same as shown in FIG. 2. The CTCSS system in which HE5 is excluded is referred to as Variant 1*b*.

The CTCSSs of this invention provide highly effective utilization of heat available from the condensing stream S100 of the working solution having the parameters as at the point 138 and of heat from external sources such as from the stream S152.

In distinction from an analogous system described in the prior art, the lean liquid stream S146 having the parameters as at the point 7 coming from the first separator S1, is not cooled in a separate heat exchanger, but rather a portion of the stream S146 is injected into the stream S100 of working fluid returning from the power system.

When the stream S136 of basic solution having the parameters as at the point 12 starts to boil, it initially requires a substantial quantity of heat, while at the same time its rise in temperature is relatively slow. This portion of the reboiling process occurs in the second heat exchanger HE2. In the process of further reboiling, the rate of increase in the temperatures becomes much faster. This further portion of the reboiling process occurs in the first heat exchanger HE1. At the same time, in the process of condensation of the stream S104 having the parameters as at the point 38, initially a relatively large quantity of heat is released, with a relatively slow reduction of temperature. But in further condensation, the rate of reduction of temperature is much higher. As a result of this phenomenon, in the prior art, the temperature differences between the condensing stream of working solution and the reboiling stream of basic solution are minimal at the beginning and end of the process, but are quite large in the middle of the process.

In contrast to the prior art, in the CTCSS of this invention, the concentration of the low boiling component in stream S108 having the parameters as at the point 8 is relatively low and therefore in the second heat exchanger HE2, stream S108 having the parameters as at the point 8 not only condenses itself, but has the ability to absorb additional vapor. As a result, the quantity of heat released in the second heat exchanger HE2 in the second heat exchange process is substantially larger than it would be if streams S108 and S106 having the parameters as at the points 8 and 15, respectively, were cooled separately and not collectively collect after combining the two stream S108 and S106 to form the stream S110. As a result, the quantity of heat available for the reboiling process comprising the first and second heat exchange processes is substantially increased, which in turn increases the efficiency of the CTCSS system.

The leaner the stream S108 having the parameters at as the point 8 is, the greater its ability to absorb vapor, and the greater the efficiency of the heat exchange processes occurring in the first and second heat exchangers HE1 and HE2. But the composition of the stream S108 having the parameters at as the point 8 is defined by the temperature of the stream S142 having the parameters as at the point 5; the higher the temperature of the stream S142 having the parameters as at the point 5, the leaner the composition of stream S108 having the parameters at as the point 8 can be.

It is for this reason that external heat derived from stream S152 is used to heat stream S148 having the parameters as at the point 70, thus raising the temperature of the stream S104 having the parameters as at the point 38, and as a result also raising the temperature of the stream S142 having the parameters as at the point 5. However, increasing of the temperature of the stream S142 having the parameters as at the point 5, and correspondingly the temperature of the stream S144 having the parameters as at a point 6, leads to a reduction in a concentration of the low boiling component in the vapor stream S144 having the parameters as at the point 6.

Use of the scrubber SC1, in place of a heat exchanger, for the utilization of heat from the stream S144 having the parameters as at the point 6 allows both the utilization of the heat from the stream S144 having the parameters as at the point 6 and an increase of the concentration of low boiling component in the produced vapor stream S162 having the parameters as at the point 30.

The vapor stream S162 having the parameters as at the point 30 has a concentration of low-boiling component which is higher than the concentration of the low boiling component in the vapor stream S144 having the parameters as at the point 6, and the flow rate of stream S162 having the parameters as at the point 30 is higher than the flow rate of the stream S144 having the parameters as at the point 6.

The concentration of low boiling component in the working fluid is restored in the stream S184 having the parameters at the point 26, by mixing the stream S166, a very rich solution, having the parameters as at the point 25 (or the stream S162 having the parameters as at the point 30, in the case of the Variant 1*b*), with the stream S182 having the parameters as at the point 40. The stream S182 having the parameters as at point 40 has a higher concentration of low boiling component than the basic solution, (i.e., is enriched). Such an enrichment has been used in the prior art, but in the prior art, in order to obtain this enrichment, a special intermediate pressure reboiling process is needed requiring several additional heat exchangers.

In the CTCSSs of this invention, all heat that is available at a temperature below the boiling point of the basic solution (i.e., below the temperature of the stream S130 having the parameters as at the point 14) is utilized in a single heat exchanger, the third heat exchanger HE3. Thereafter, the vapor needed to produce the enriched stream S182 having the parameters as at the point 40 is obtained simply by throttling the stream S132 having the parameters as at the point 13.

In U.S. Pat. No. 5,572,871, a DCSS (CTCSS) required 13 heat exchangers and three separators, and did not provide for the potential utilization of external heat. In contrast, the CTCSS of the present invention, which does provide for the utilization of external heat, requires only eight heat exchangers, two separators and one scrubber (which is substantially simpler and less expensive than a heat exchanger.)

A table of example parameters of all points for variant 1*b* is presented in Table 1.

Table 1

CTCSS State Points Summary (Variant 1b)

| Point | X (lb/lb) | T (° F.) | P (psia) | H (Btu/lb) | S (Btu/lb-R) | G rel (G/G = 1) | Phase | Wetness (lb/lb/) or T (° F.) |
|---|---|---|---|---|---|---|---|---|
| | | | | Working Fluid | | | | |
| 01 | 0.4640 | 65.80 | 30.772 | −72.3586 | 0.0148 | 8.39248 | Mix | 1 |
| 02 | 0.4640 | 65.97 | 73.080 | −72.0625 | 0.0151 | 8.39248 | Liq | −45.53° F. |
| 03 | 0.6635 | 103.77 | 73.080 | 180.1339 | 0.4592 | 0.49176 | Mix | 0.6584 |
| 04 | 0.4640 | 65.97 | 73.080 | −72.0625 | 0.0151 | 8.08657 | Liq | −45.53° F. |
| 05 | 0.4640 | 191.03 | 100.823 | 234.3143 | 0.5229 | 1.83999 | Mix | 0.7351 |
| 06 | 0.9337 | 191.03 | 100.823 | 662.3343 | 1.2517 | 0.48733 | Mix | 0 |
| 07 | 0.2948 | 191.03 | 100.823 | 80.1075 | 0.2603 | 1.35266 | Mix | 1 |
| 08 | 0.2948 | 143.93 | 34.772 | 80.1074 | 0.2651 | 1.34681 | Mix | 0.93 |
| 11 | 0.4640 | 137.27 | 102.823 | 24.6957 | 0.1857 | 1.83999 | Mix | 0.9707 |
| 12 | 0.4640 | 133.62 | 104.823 | 2.9022 | 0.1490 | 1.83999 | Mix | 1 |
| 13 | 0.4640 | 133.62 | 104.823 | 2.9022 | 0.1490 | 5.99531 | Mix | 1 |
| 14 | 0.4640 | 133.62 | 104.823 | 2.9022 | 0.1490 | 8.08657 | Mix | 1 |
| 15 | 0.7277 | 143.93 | 34.772 | 463.0612 | 0.9967 | 1.23621 | Mix | 0.2994 |
| 16 | 0.5020 | 143.93 | 34.772 | 263.3857 | 0.6153 | 2.58302 | Mix | 0.6282 |
| 17 | 0.5020 | 138.62 | 33.772 | 247.8614 | 0.5906 | 2.58302 | Mix | 0.6417 |
| 18 | 0.5020 | 76.28 | 32.772 | 13.9449 | 0.1776 | 2.58302 | Mix | 0.8841 |
| 19 | 0.4640 | 80.93 | 32.772 | −6.8178 | 0.1376 | 8.39248 | Mix | 0.9257 |
| 21 | 0.4640 | 131.71 | 100.823 | 2.9022 | 0.1490 | 0.25126 | Mix | 0.9964 |
| 22 | 0.4640 | 133.62 | 104.823 | 2.9022 | 0.1490 | 2.09125 | Mix | 1 |
| 23 | 0.6635 | 65.80 | 71.080 | −56.4301 | 0.0224 | 0.49176 | Mix | 1 |
| 24 | 0.9337 | 191.03 | 100.823 | 662.3343 | 1.2517 | 0.48733 | Mix | 0 |
| 25 | 0.9911 | 131.71 | 100.823 | 600.2216 | 1.1578 | 0.50824 | Mix | 0 |
| 26 | 0.8300 | 87.68 | 100.823 | 277.4277 | 0.6017 | 1.00000 | Mix | 0.4842 |
| 27 | 0.8300 | 65.80 | 98.823 | −17.0503 | 0.0497 | 1.00000 | Mix | 1 |
| 28 | 0.8300 | 70.73 | 1,900.000 | −7.8325 | 0.0525 | 1.00000 | Liq | −256.82° F. |
| 29 | 0.8300 | 70.73 | 1,900.000 | −7.8325 | 0.0525 | 1.00000 | Liq | −256.82° F. |
| 30 | 0.9911 | 131.71 | 100.823 | 600.2216 | 1.1578 | 0.50824 | Mix | 0 |
| 31 | 0.4640 | 65.97 | 73.080 | −72.0625 | 0.0151 | 0.30591 | Liq | −45.53° F. |
| 32 | 0.4471 | 116.52 | 73.080 | −16.0494 | 0.1167 | 5.80941 | Mix | 1 |
| 34 | 0.9919 | 116.52 | 73.080 | 595.1359 | 1.1849 | 0.18590 | Mix | 0 |
| 35 | 0.2948 | 191.03 | 100.823 | 80.1075 | 0.2603 | 0.23036 | Mix | 1 |
| 38 | 0.7277 | 196.03 | 35.772 | 775.0604 | 1.4862 | 1.23621 | Vap | 0° F. |
| 40 | 0.6635 | 65.96 | 100.823 | −56.1779 | 0.0227 | 0.49176 | Liq | −19.53° F. |
| 41 | 0.4471 | 82.91 | 32.772 | −16.0494 | 0.1196 | 5.80941 | Mix | 0.9442 |
| 43 | 0.4640 | 116.52 | 73.080 | 2.9022 | 0.1498 | 5.99531 | Mix | 0.969 |
| 44 | 0.4640 | 66.12 | 109.823 | −71.8156 | 0.0153 | 8.08657 | Liq | −70.52° F. |
| 45 | 0.2948 | 143.93 | 34.772 | 80.1075 | 0.2651 | 0.23036 | Mix | 0.93 |
| 70 | 0.2948 | 191.03 | 100.823 | 80.1075 | 0.2603 | 0.23621 | Mix | 1 |
| 71 | 0.2948 | 227.10 | 35.772 | 615.2057 | 1.0815 | 0.23621 | Mix | 0.4122 |
| 72 | 0.2948 | 191.03 | 100.823 | 80.1075 | 0.2603 | 1.11645 | Mix | 1 |
| 73 | 0.2948 | 143.93 | 34.772 | 80.1075 | 0.2651 | 1.11645 | Mix | 0.93 |
| 74 | 0.2948 | 284.54 | 98.823 | 615.2060 | 1.0182 | 0.23621 | Mix | 0.4545 |
| 138 | 0.8300 | 358.47 | 35.772 | 812.8197 | 1.5611 | 1.00000 | Vap | 181.2° F. |
| | | | | External Heat Source | | | | |
| 638 | AIR | 351.74 | 12.976 | 99.4176 | 0.5970 | 3.83489 | Vap | 666.2° F. |
| 639 | AIR | 216.03 | 12.904 | 66.4582 | 0.5529 | 3.83489 | Vap | 530.5° F. |
| | | | | Coolant | | | | |
| 51 | water | 51.80 | 24.693 | 19.9498 | 0.0396 | 27.3421 | Liq | −187.56° F. |
| 52 | water | 71.93 | 14.693 | 40.0672 | 0.0783 | 27.3421 | Liq | −140.03° F. |
| 53 | water | 51.80 | 24.693 | 19.9498 | 0.0396 | 13.6854 | Liq | −187.56° F. |
| 54 | water | 73.33 | 14.693 | 41.4676 | 0.0809 | 13.6854 | Liq | −138.63° F. |
| 55 | water | 51.80 | 24.693 | 19.9498 | 0.0396 | 3.07700 | Liq | −187.56° F. |
| 56 | water | 89.63 | 14.693 | 57.7573 | 0.1110 | 3.07700 | Liq | −122.32° F. |

Figure 3:
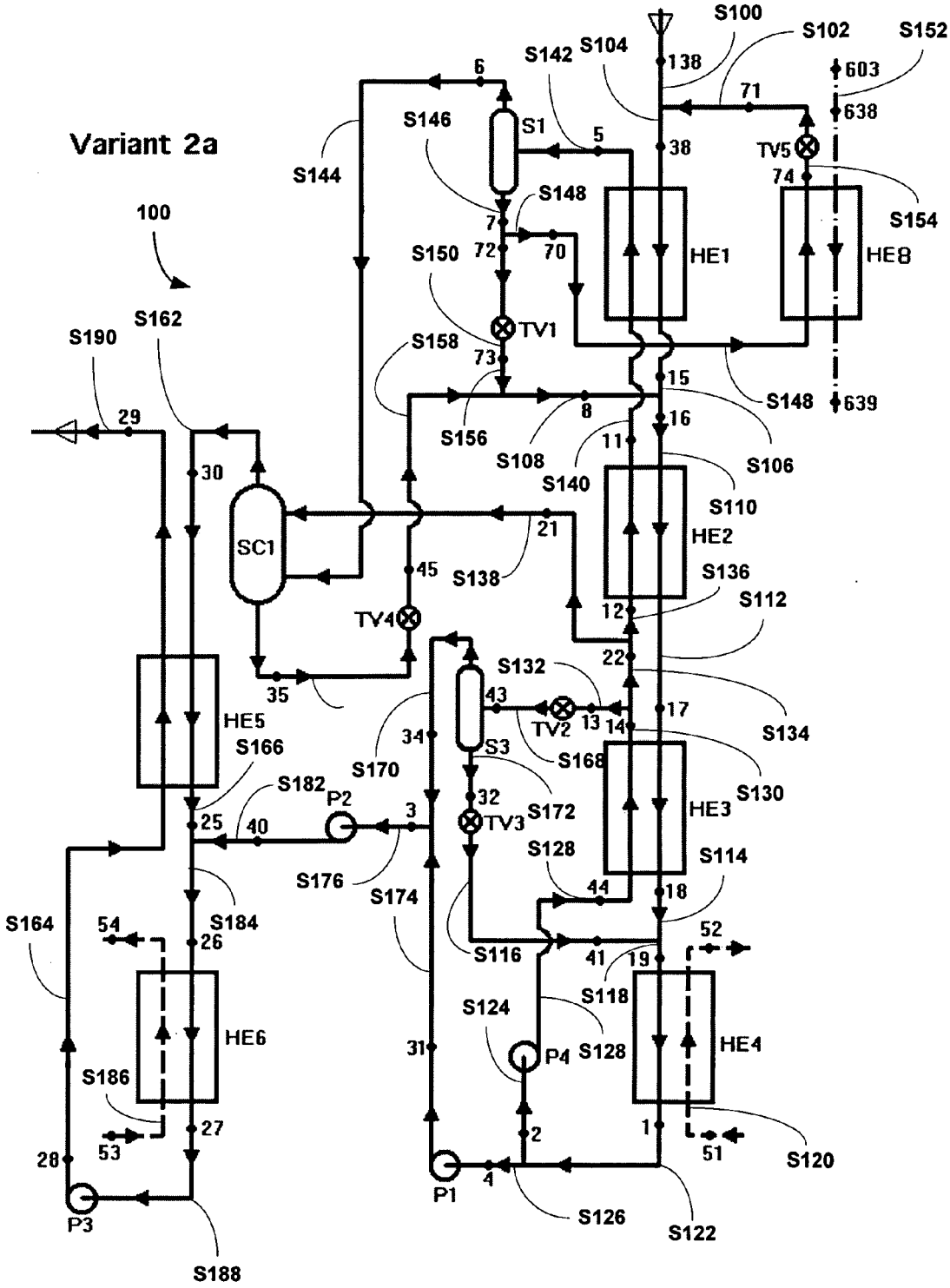
FIG. 3 depicts a block diagram of a preferred embodiment of Variant 2*a* of a condensation and thermal compression subsystems.
Figure 4:
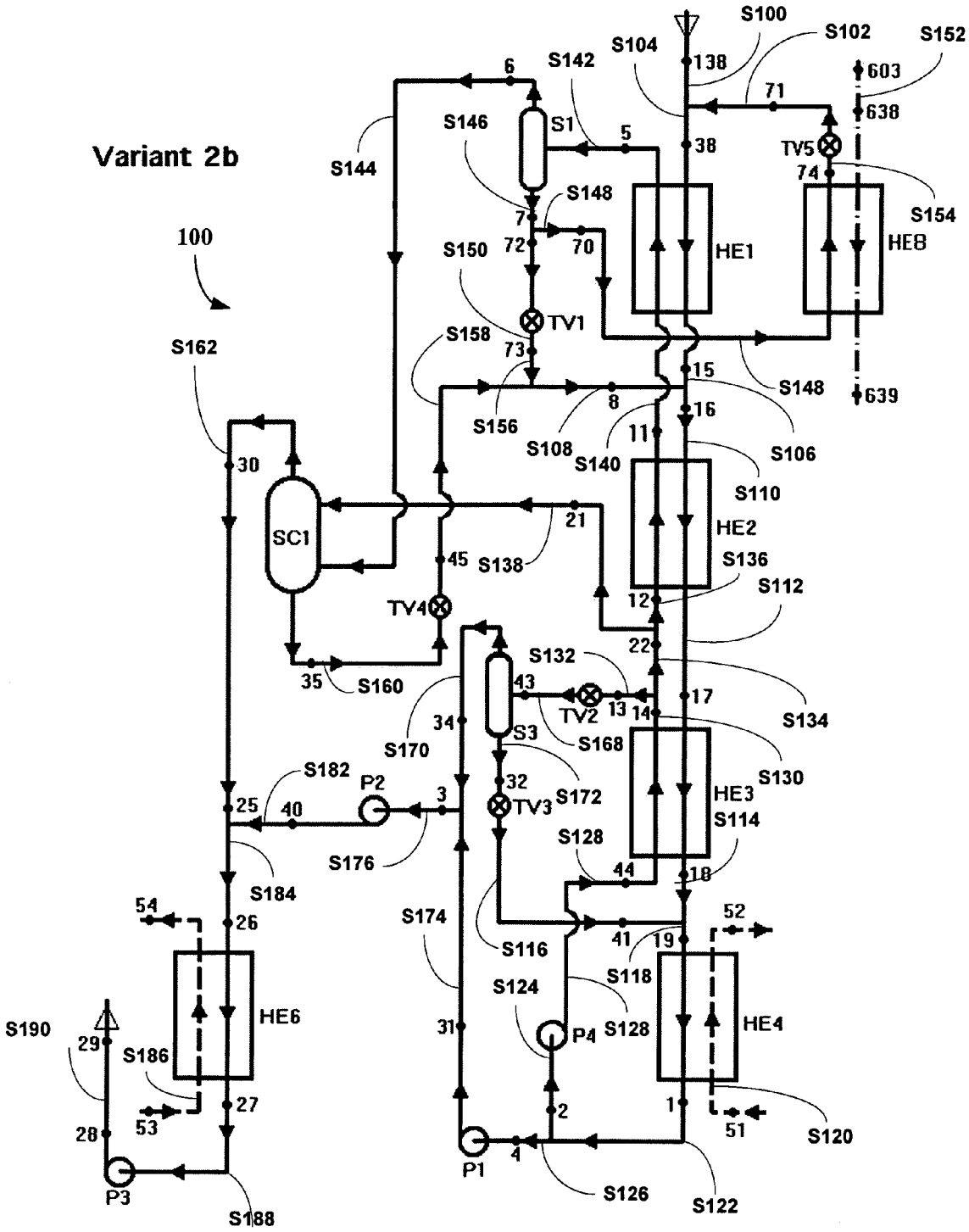
FIG. 4 depicts a block diagram of a preferred embodiment of Variant 2*b* of a condensation and thermal compression subsystems.

The CTCSSs of this invention can be simplified by eliminating some "modular" components. For instance, it is possible to enrich the stream S182 having the parameters as at the point 40 without using the intermediate pressure condenser, the seventh heat exchanger HE7. Such a system, with preheating of the stream S164 of working fluid having the parameters as at the point 28 is shown in FIG. 3, and referred to as Variant 2*a*. A similar system, but without preheating the stream S164 of working fluid having the parameters as at the point 28, is shown in FIG. 4, and referred to as Variant 2*b*.

In the Variant 2*a* and Variant 2*b*, in distinction to the Variant 1*a* and Variant 1*b*, the pressure of the stream S168 having the parameters as at the point 43 is chosen in such a way that the when mixing the vapor stream S170 having the parameters as at the point 34 and the liquid stream S174 having the parameters as at the point 31, the subcooled liquid stream S174 having the parameters as at the point 31 fully absorbs the vapor stream S170 having the parameters as at the point 34, and the resulting stream S176 having the parameters as at the point 3 is in a state of saturated, or slightly subcooled, liquid. Thereafter, the liquid S176 having the parameters as at the point 3 is sent into the second pump P2, to form the stream S182 having the parameters as at the point 40, and is mixed with stream 25.

The simplification of the CTCSS of Variant 2*a* and Variant 2*b* reduces the overall efficiency of the CTCSSs of this invention, but at the same time, the cost is also reduced.

Figure 5:
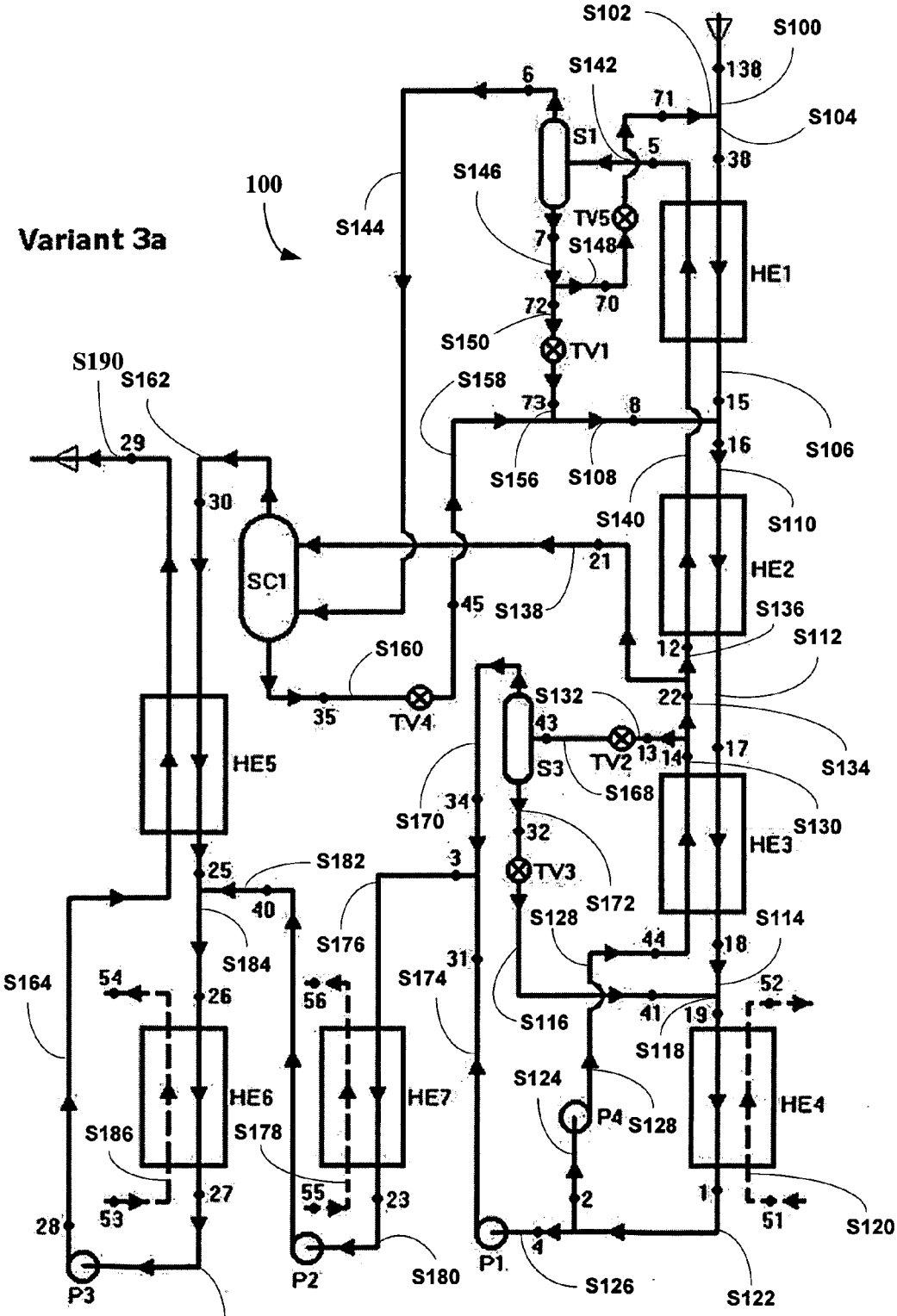
FIG. 5 depicts a block diagram of a preferred embodiment of Variant 3*a* of a condensation and thermal compression subsystems.
Figure 6:
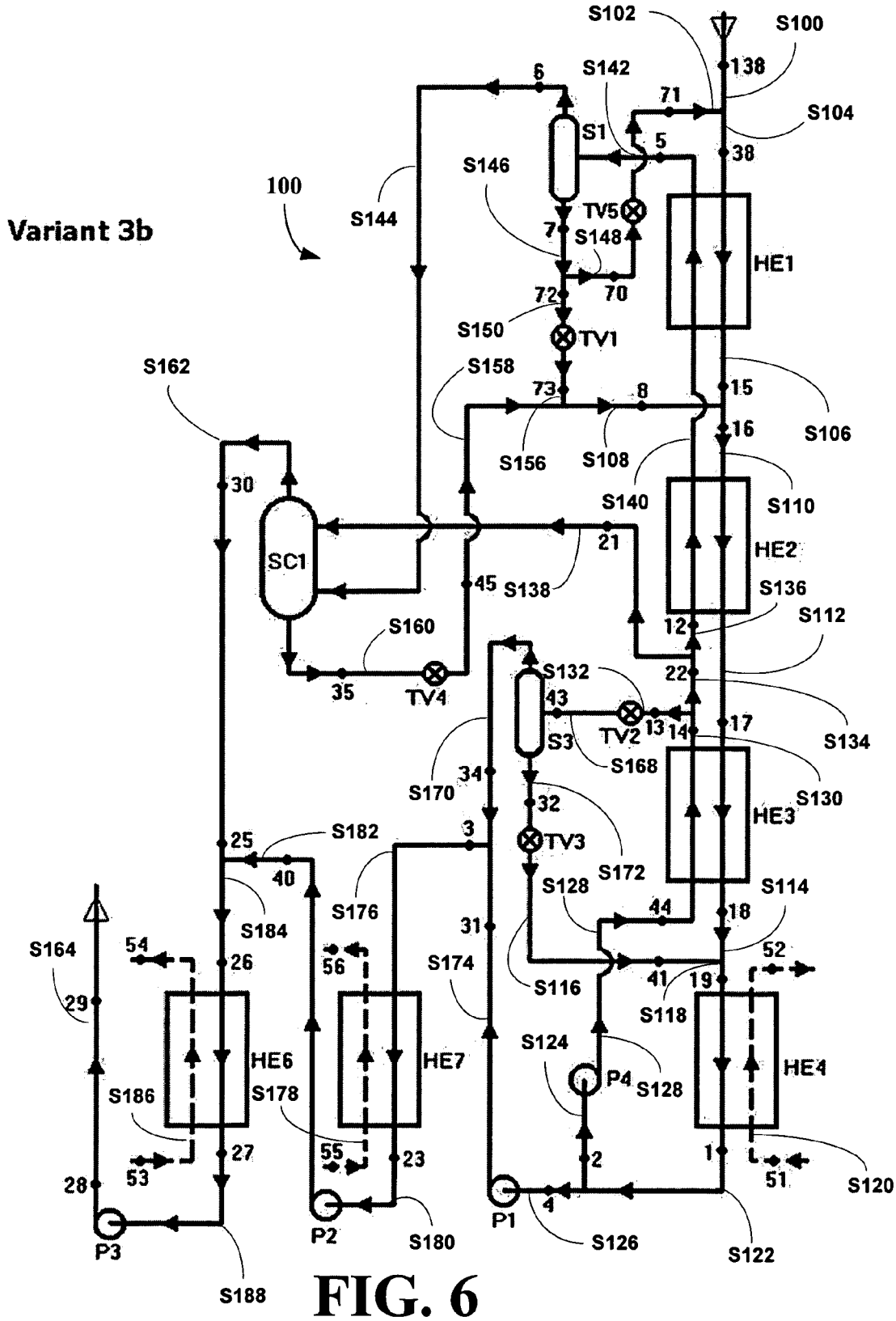
FIG. 6 depicts a block diagram of a preferred embodiment of Variant 3*b* of a condensation and thermal compression subsystems.

Another possible modular simplification of the Variant 1*a* and Variant 1*b* can be used in a case where external heat is not available, or the choice is made not to utilize external heat. Such a variant of the CTCSS of this invention, with preheating of the stream S164 of working fluid having the parameters as at the point 28 is shown in FIG. 5, and is referred to as Variant 3*a*. A similar CTCSS of this invention, but without preheating the stream S164 of the working fluid having the parameters as at the point 28, is shown in FIG. 6, and referred to as Variant 3*b*.

In Variant 3*a* and Variant 3*b*, the stream S148 having the parameters as at the point 70 is not heated, but rather simply passes through the fifth throttle valve TV5, to form the stream S102 having the parameters as at the point 71, and is then mixed with the stream S100 having the parameters as at the point 138, forming the stream S104 having the parameters as at the point 38. This mixing process is used only in a case where the stream S100 having the parameters as at the point 138 is in a state of superheated vapor. The flow rate of streams S148 and S102 having the parameters as at the points 70 and 71 is chosen in such a way that the stream S104 having the parameters as at the point 38 formed as a result of mixing the stream S102 having the parameters as at the point 71 and the stream S100 having the parameters as at the point 138 is in a state of saturated, or slightly wet, vapor.

Figure 7:
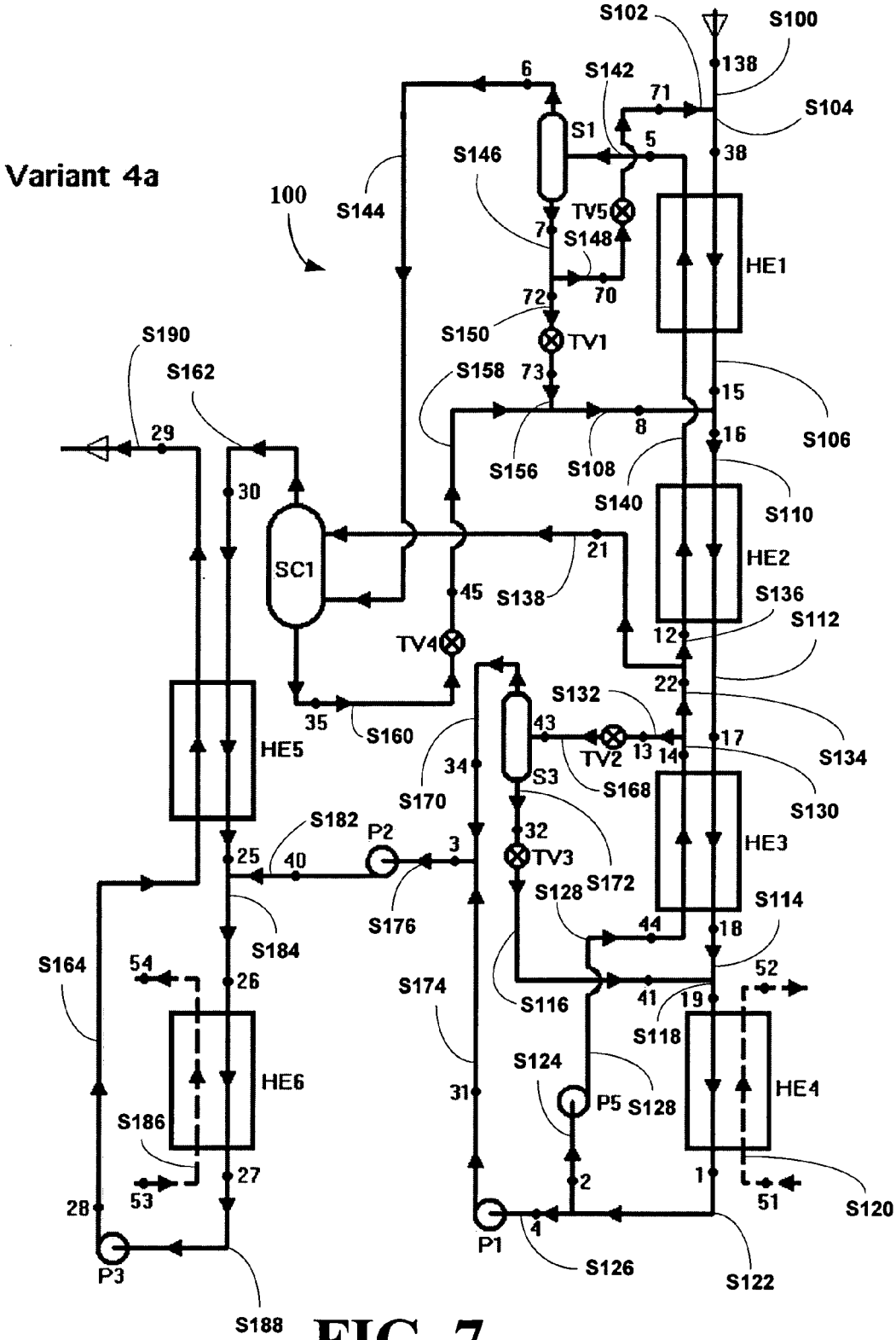
FIG. 7 depicts a block diagram of a preferred embodiment of Variant 4*a* of a condensation and thermal compression subsystems.
Figure 8:
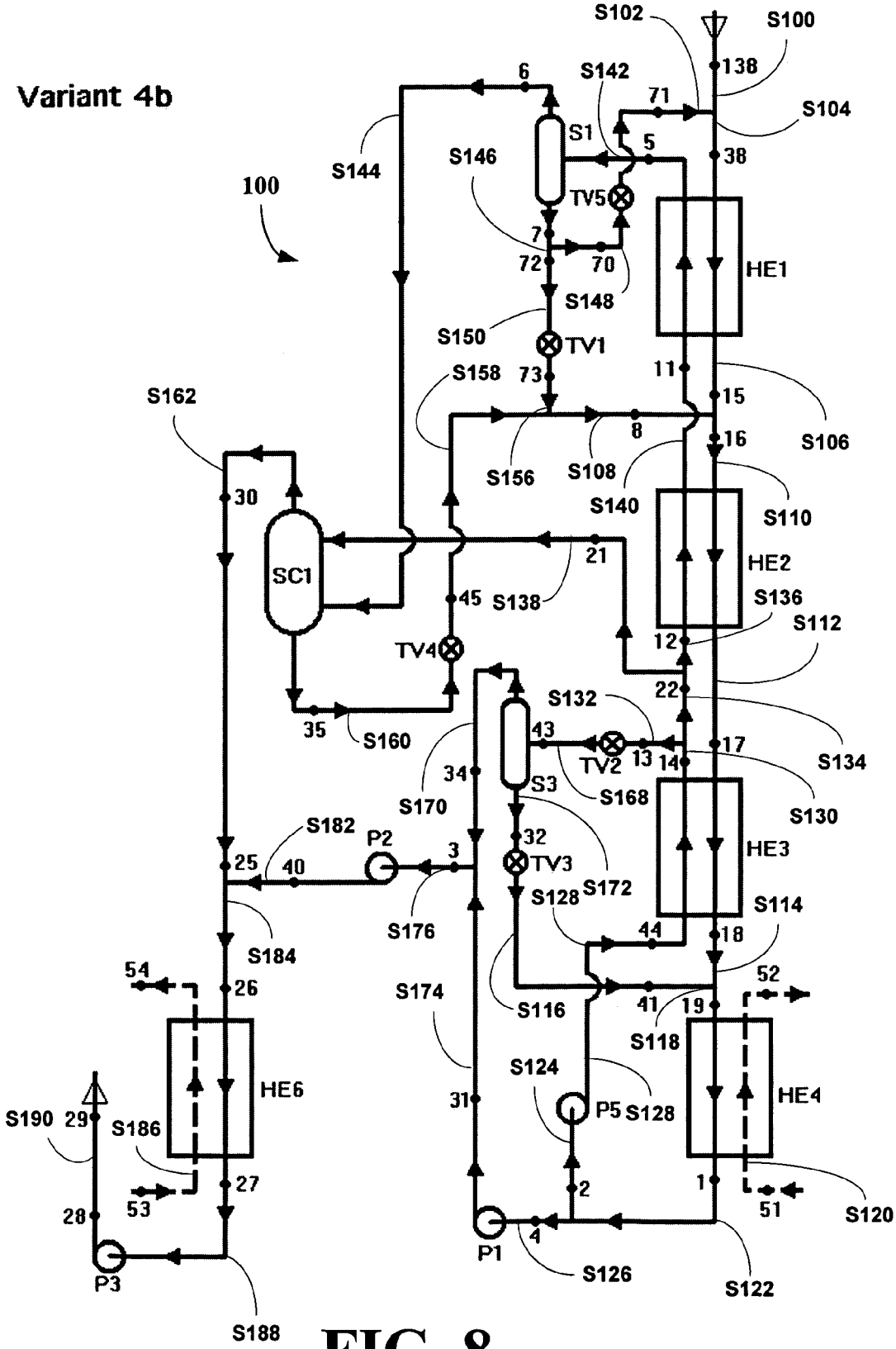
FIG. 8 depicts a block diagram of a preferred embodiment of Variant 4*b* of a condensation and thermal compression subsystems.

It is also possible to simplify Variant 2*a* and Variant 2*b* in the same manner than Variant 1*a* and Variant 1*b* are simplified to obtain Variant 3*a* and Variant 3*b*. This modular simplification of Variant 2*a* and Variant 2*b*, with preheating of the stream S164 of the working fluid having the parameters as at the point 28 is shown in FIG. 7, and is referred to as Variant 4*a*; while a similar simplification of Variant 2*b*, without preheating the stream S164 of the working fluid having the parameters as at the point 28, is shown in FIG. 8, and referred to as Variant 4*b*.

Figure 9:
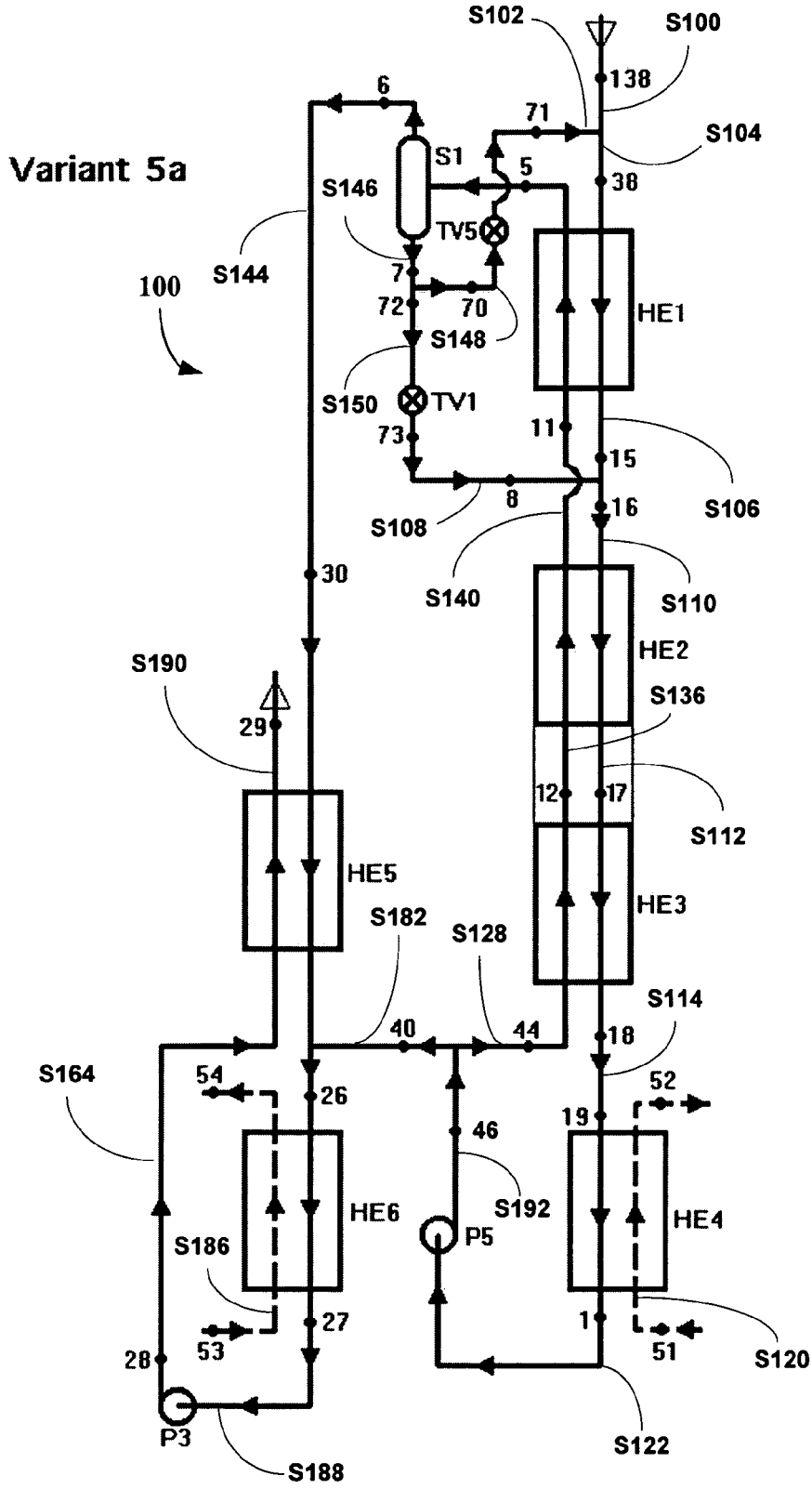
FIG. 9 depicts a block diagram of a preferred embodiment of Variant 5*a* of a condensation and thermal compression subsystems.
Figure 10:
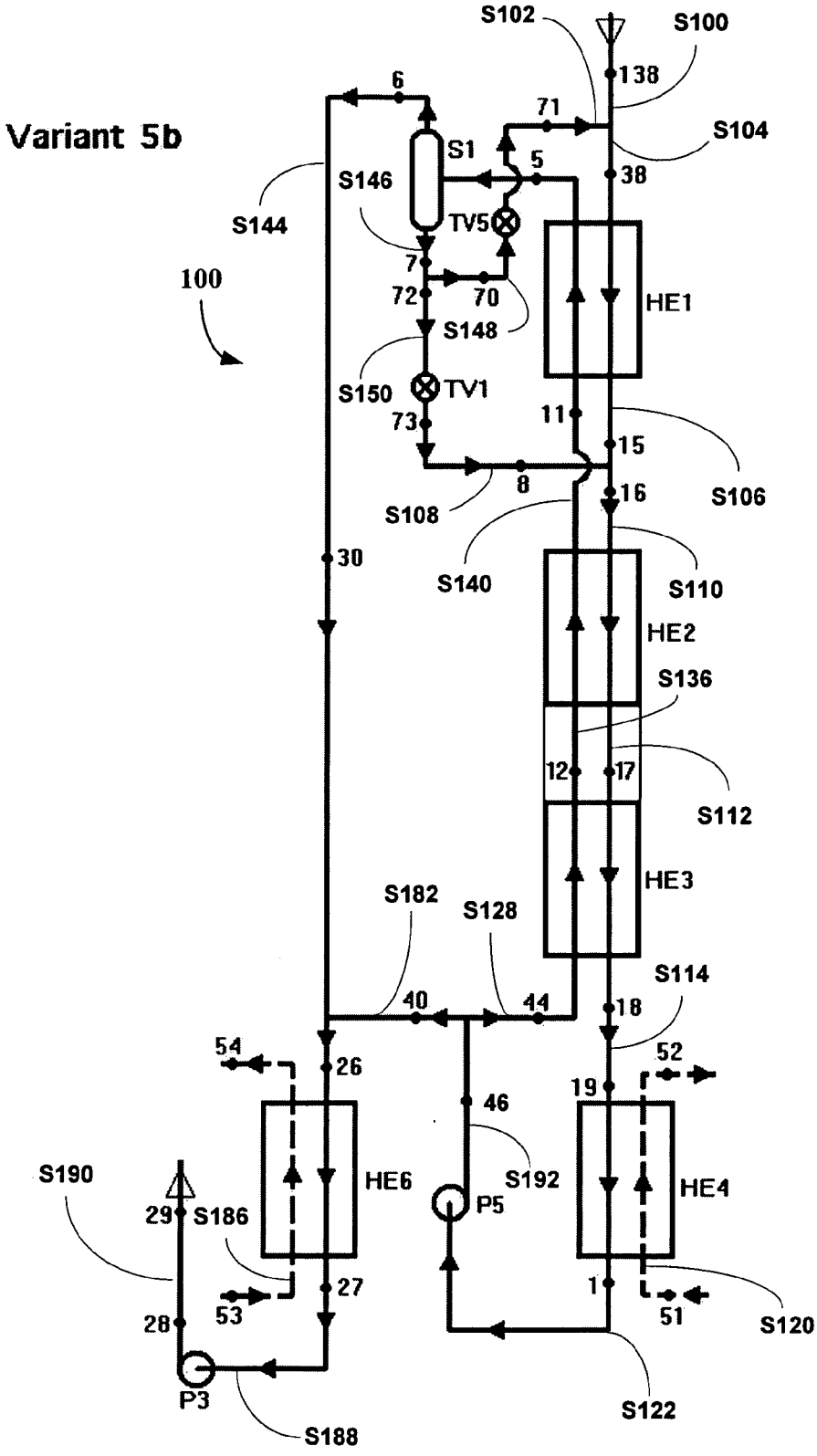
FIG. 10 depicts a block diagram of a preferred embodiment of Variant 5*b* of a condensation and thermal compression subsystems.

A final modular simplification is attained by eliminating the scrubber SC1, and the use of the stream S182 having the parameters as at the point 40 without any enrichment, i.e., the composition of stream S182 having the parameters as at the point 40 is the same as the composition of the basic solution. This modular simplification of Variant 4*a*, with preheating of the stream S164 of the working fluid having the parameters as at the point 28 is shown in FIG. 9, and is referred to as Variant 5*a*. A similar simplification of Variant 4*b*, without preheating the stream S164 of the working fluid having the parameters as at the point 28, is shown in FIG. 10, and referred to as Variant 5*b*. It must be noted that the modular simplification of the Variant 5*a* and Variant 5*b* results in a substantial reduction of the efficiency of the CTCSS. Also in Variants 5*a* and 5*b*, the stream S122 having the parameters as at the point 1 is not split into two substreams S122 and S124 which are then separately pressurized, but is pressurized in as a single stream in a pump P5 forming a stream S192 having parameters as at a point 46. The stream S192 is then split to form the stream S128 having the parameters as at the point 44 and the stream S182 having the parameters as at the point 40.

The CTCSSs of this invention is described in the five basic variants given above; (two of which utilize external heat, and three of which utilize only the heat available from the stream S100 of the working fluid entering the CTCSSs of this invention). One experienced in the art would be able to generate additional combinations and variants of the proposed systems. For instance, it is possible to simplify Variant 4*a* by eliminating the scrubber SC1, while retaining the enrichment of the stream S182 having the parameters as at the points 40. (Likewise it is possible to retain the scrubber SC1, and eliminate only the enrichment process for the stream S182 having the parameters as at the points 40.) However all such modular simplifications are still based on the initial Variant 1*a* of the CTCSSs of this invention.

The efficacy of the CTCSS of this invention, per se, can be assessed by its compression ratio; i.e., a ratio of the pressure of the stream S184 having the parameters as at the point 26 (at the entrance to the high pressure condenser, heat exchanger HE6) to the pressure of the stream S100 having the parameters as at the point 138 (at the point of entrance of the stream of working solution into the CTCSS). The impact of the efficacy of the CTCSS on the efficiency of the whole system depends on the structure and parameters of work of the whole system. For assessing the CTCSSs of this invention, several calculations have been performed. A stream comprising a water-ammonia mixture having a composition of 0.83 weight fraction of ammonia (i.e., 83 wt. % ammonia), with an initial temperature of 1050° F. and an initial pressure of 1800 psia, has been expanded in a turbine with an isoenthropic efficiency of 0.875 (87.5%). The parameters of the vapor upon exiting the turbine correspond to the stream S100 having the parameters at the point 138. Such computations have been performed for all proposed "b" variants of the CTCSS of this invention described above, and for a simple condenser system as well. These calculations are presented in Table 2. It should be noted that the incremental enthalpy drop produced by using a CTCSS of this invention is specific to the exact parameters of pressure and temperature at the turbine inlet. If these parameters were to be lowered, then the percentage of increase in enthalpy drop would be substantially larger.

TABLE 2

| | Efficacy of CTCSS Variants 1b, 2b, 3b, 4b, and 5b | | | | | |
|---|---|---|---|---|---|---|
| | Simple Condenser | CTCSS Variant 1b | CTCSS Variant 2b | CTCSS Variant 3b | CTCSS Variant 4b | CTCSS Variant 5b |
| pressure of turbine outlet (point 138) (psia) | 100.823 | 35.771 | 38.972 | 42.067 | 45.079 | 59.368 |
| compression ratio (P26:P138) | 1.000 | 2.8181 | 2.5871 | 2.3967 | 2.2366 | 1.69827 |
| turbine enthalpy drop (btu/lb) | 337.3891 | 418.6930 | 412.5639 | 407.0011 | 410.8869 | 380.7543 |
| incremental enthalpy drop (btu/lb) | 0.000 | 81.3040 | 75.1748 | 69.6119 | 64.4978 | 43.3652 |
| incremental enthalpy drop (%) | 0.000 | 24.098 | 22.281 | 20.633 | 19.117 | 12.853 |

Comparison has shown that all variants of the CTCSSs of this invention have an efficacy that is higher or equal to comparable subsystems in the prior art. However, all of the proposed CTCSS are substantially simpler and less expensive than the subsystems described in the prior art.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that maybe made which do not depart from the scope and spirit of the invention as described above and claimed hereafter.

I claim:

1. A condensation and thermal compression system comprising:

a separation subsystem comprising a separator adapted to produce a rich vapor stream and a lean liquid stream;

a heat exchange subsystem comprising three heat exchangers and two throttle control valves adapted to mix a pressure adjusted first portion of the lean liquid stream with an incoming stream to form a pre-basic solution stream, to mix a pressure adjusted second portion of the lean liquid stream with the pre-basic solution stream to form a basic solution stream, to bring a first portion of a pressurized fully condensed basic solution stream into a heat exchange relationship with the pre-basic solution stream to form a partially condensed basic solution stream;

a first condensing and pressurizing subsystem comprising a first condenser and a first pump adapted to fully condense the partially condensed basic solution stream to form a fully condensed basic solution stream and to pressurize the fully condensed basic solution stream to form a pressurized fully condensed working fluid stream; and a second condensing and pressurizing subsystem comprising a second condenser and a second pump adapted to mix a second portion of the fully condensed basic solution stream and the rich vapor stream to form an outgoing stream, to fully condense the outgoing stream and to pressurize the outgoing stream to a desired high pressure, where the first portion of the lean liquid stream is pressure adjusted to have the same or substantially the same pressure as the incoming stream and where the second portion of the lean stream is pressure adjusted to have the same or substantially the same pressure as the pre-basic solution stream and where the streams comprise at least one lower boiling component and at least one higher boiling component and the compositions of the streams are the same or different with the composition of the incoming stream and the outgoing stream being the same.

2. The system of claim 1, wherein the second condensing and pressurizing subsystem further comprising a heat exchanger adapted to cool the rich vapor stream and heating the high pressure outgoing working fluid stream.

3. The system of claim 1, wherein the composition of the incoming stream or the outgoing stream is selected from the group consisting of an ammonia-water mixture, a mixture of two or more hydrocarbons, a mixture of two or more freons, and a mixture of hydrocarbons and freons.

4. The system of claim 1, wherein the composition of the incoming stream or the outgoing stream comprises a mixture of water and ammonia.

5. A condensation and thermal compression system comprising:

a separation subsystem comprising two separators and one scrubber adapted to produce three rich vapor streams and three lean liquid stream and to forward the first rich vapor stream from the first separator to the scrubber;

a heat exchange subsystem comprising three heat exchangers and five throttle control valves adapted: (7) to mix an incoming stream and a pressure adjusted, first portion of a first lean liquid stream from the first separator through the first throttle control valve to form a lean mixed stream, (8) to bring into a heat exchange relationship a heated first portion of a first pressurized basic solution substream and the lean mixed stream in a first heat exchanger to form a cooled lean mixed stream and a partially vaporized, pressurized basic solution stream, (9) to forward the partially vaporized, pressurized basic solution stream to the first separator, (10) to mix the cooled lean mixed stream and a pressure adjusted, second portion of the first lean liquid stream from the first separator through the second throttle control valve and a pressure adjusted, second lean liquid stream from the scrubber through the third throttle control valve to form a pre-basic solution stream, (11) to bring into a heat exchange relationship the pre-basic solution stream and a pre-heated, first portion of the first pressurized basic solution substream in the second heat exchanger to form a cooled pre-basic solution stream and the heated first portion of the first pressurized basic solution substream, (12) to forward a second portion of the pre-heated first pressurized basic solution substream to the scrubber, (13) to forward a third portion of the pre-heated first pressurized basic solution substream to the second separator through the fourth throttle control valve, (14) to bring into a heat exchange relationship the cooled pre-basic solution stream and the first pressurized basic solution substream in a third heat exchanger to form a cooler pre-basic solution stream and the pre-heated first pressurized basic solution substream, and (15) to mix the cooler pre-basic solution stream and a pressure adjusted third lean liquid stream from the second separation through the fifth throttle control valve to form a partially condensed basic solution stream, a first condensing and pressurizing subsystem comprising a first condenser and three pumps adapted: (1) to fully condense the partially condensed basic solution stream in the first condenser using a first external coolant stream to form a fully condensed basic solution stream; (2) to split the fully condensed basic solution stream into a first fully condensed basic solution substream and a second fully condensed basic solution substream; (3) to pressurize the first fully condensed basic solution substream through the first pump to form the first pressurized fully condensed basic solution substream; (4) to pressurize the second fully condensed basic solution substream through the second pump to form a second pressurized fully condensed basic solution substream; (5) to mix the second pressurized fully condensed basic solution substream and the second rich vapor stream from the second separator to form a pre-outgoing stream; (6) to pressurize the pre-outgoing stream in the third pump to form a pressurized pre-outgoing stream; and (7) to mix the pressurized pre-outgoing stream with the third rich vapor stream from the scrubber to form a partially condensed outgoing stream; and a second condensing and pressurizing subsystem comprising a second condenser and a fourth pump adapted to fully condense the partially condensed outgoing stream in the second condenser using a second external coolant stream to form a fully condensed outgoing stream and to pressurize the fully condensed outgoing stream to a desired high pressure to form an outgoing stream, where the streams comprise at least one lower boiling component and at least one higher boiling component and the compositions of the streams are the same or different with the composition of the incoming stream and the outgoing stream being the same.

6. The system of claim 5, wherein the second condensing and pressurizing subsystem further comprising a fourth heat exchanger adapted to bring the third rich vapor stream and the outgoing stream heating the outgoing stream to a desired higher temperature.

7. The system of claim 5, wherein the composition of the incoming stream or the outgoing stream is selected from the group consisting of an ammonia-water mixture, a mixture of two or more hydrocarbons, a mixture of two or more freons, and a mixture of hydrocarbons and freons.

8. The system of claim 5, wherein the composition of the incoming stream or the outgoing stream comprises a mixture of water and ammonia.

9. The system of claim 5, wherein the first condensing and pressurizing subsystem further comprising a third condenser adapted to fully condense a pre-outgoing stream in the third condenser using a third external coolant stream to form a fully condensed, pre-outgoing stream prior to being pressurized in the third pump and mixed with the third rich vapor stream to form the partially condensed outgoing stream.

10. The system of claim 9, wherein the second condensing and pressurizing subsystem further comprising a fourth heat exchanger adapted to bring the third rich vapor stream and the outgoing stream heating the outgoing stream to a desired higher temperature.

11. The system of claim 5, wherein the heat exchange subsystem further comprising a fifth heat exchanger adapted to bring into a heat exchange relationship the first portion of the first lean liquid stream from the first separator and an external heat carrier stream to from a heated first portion of the first lean liquid stream prior to passing through the first throttle control valve and being mixed with the incoming stream.

12. The system of claim 11, wherein the second condensing and pressurizing subsystem further comprising a fourth heat exchanger adapted to bring the third rich vapor stream and the outgoing stream heating the outgoing stream to a desired higher temperature.

13. The system of claim 11, wherein the first condensing and pressurizing subsystem further comprising a third condenser adapted to fully condense a pre-outgoing stream in the third condenser using a third external coolant stream to form a fully condensed, pre-outgoing stream prior to being pressurized in the third pump and mixed with the third rich vapor stream to form the partially condensed outgoing stream.

14. The system of claim 13, wherein the second condensing and pressurizing subsystem further comprising a fourth heat exchanger adapted to bring the third rich vapor stream and the outgoing stream heating the outgoing stream to a desired higher temperature.

15. A method comprising the steps of:

a. mixing an incoming stream and a pressure adjusted first portion of a lean liquid stream to form a pre-basic solution stream, b. bringing the pre-basic solution stream into a heat exchange relationship with a first portion of a heated, pressurized basic solution stream to form a cooled pre-basic solution stream and a partially vaporized basic solution stream, c. mixing the cooled pre-basic solution stream and a pressure adjusted second portion of the lean liquid stream to form a basic solution stream, d. bringing the basic solution stream into a heat exchange relationship with the first portion of a pressurized fully condensed basic solution stream to form a partially condensed basic solution stream and the heated, pressurized basic solution stream, e. condensing the partially condensed basic solution stream using an external coolant stream to from a fully condensed basic solution stream, f. pressurizing the fully condensed basic solution stream to form the pressurized fully condensed basic solution stream, g. separating the partially vaporized basic solution stream into a rich vapor stream and the lean liquid stream, h. mixing the vapor steam and a second portion of the pressurized fully condensed basic solution stream to form a pre-outgoing stream, I. condensing the pre-outgoing stream using a second external coolant stream to form a fully condensed, pre-outgoing stream, and j. pressurizing the fully condensed, pre-outgoing stream to a desired high pressure to form an outgoing stream, where the streams comprise at least one lower boiling component and at least one higher boiling component and the compositions of the streams are the same or different with the composition of the incoming stream and the outgoing stream being the same.

16. The method of claim 15, wherein the second bringing step includes:

a first heat exchange step where the basic solution stream is brought into heat exchange relationship with a partially heated pressurized basic solution stream to form a pre-partially condensed basic solution stream and the heated, pressurized basic solution stream, and a second heat exchange step where the pre-partially condensed basic solution stream is brought into heat exchange relationship with the first portion of the pressurized basic solution stream to from the partially condensed basic solution stream and a pre-heated, pressurized basic solution stream.

17. The method of claim 15, wherein the composition of the incoming stream or the outgoing stream is selected from the group consisting of an ammonia-water mixture, a mixture of two or more hydrocarbons, a mixture of two or more freons, and a mixture of hydrocarbons and freons.

18. The method of claim 15, wherein the composition of the incoming stream or the outgoing stream comprises a mixture of water and ammonia.

19. A method comprising the steps of:

a. mixing an incoming stream and a pressure adjusted, first portion of a first lean liquid stream to form a lean mixed stream, b. bringing into a heat exchange relationship a heated first portion of a first pressurized basic solution substream and the lean mixed stream to form a cooled lean mixed stream and a partially vaporized, pressurized basic solution stream, c. forwarding the partially vaporized, pressurized basic solution stream to the first separator, d. mixing the cooled lean mixed stream and a pressure adjusted, second portion of the first lean liquid stream from the first separator through the second throttle control valve and a pressure adjusted, second lean liquid stream from the scrubber through the third throttle control valve to form a pre-basic solution stream, e. bringing into a heat exchange relationship the pre-basic solution stream and a pre-heated, first portion of the first pressurized basic solution substream in the second heat exchanger to form a cooled pre-basic solution stream and the heated first portion of the first pressurized basic solution substream, f. forwarding a second portion of the pre-heated first pressurized basic solution substream to the scrubber, g. forwarding a third portion of the pre-heated first pressurized basic solution substream to the second separator through the fourth throttle control valve, h. bringing into a heat exchange relationship the cooled pre-basic solution stream and the first pressurized basic solution substream in a third heat exchanger to form a cooler pre-basic solution stream and the pre-heated first pressurized basic solution substream, i. mixing the cooler pre-basic solution stream and a pressure adjusted third lean liquid stream from the second separation through the fifth throttle control valve to form a partially condensed basic solution stream, j. fully condensing the partially condensed basic solution stream in the first condenser using a first external coolant stream to form a fully condensed basic solution stream;

k. splitting the fully condensed basic solution stream into a first fully condensed basic solution substream and a second fully condensed basic solution substream;

m. pressurizing the first fully condensed basic solution substream through the first pump to form the first pressurized fully condensed basic solution substream;

o. pressurizing the second fully condensed basic solution substream through the second pump to form a second pressurized fully condensed basic solution substream;

q. mixing the second pressurized fully condensed basic solution substream and the second rich vapor stream from the second separator to form a pre-outgoing stream;

s. pressurizing the pre-outgoing stream in the third pump to form a pressurized pre-outgoing stream;

u. mixing the pressurized pre-outgoing stream and the third rich vapor stream from the scrubber to form a partially condensed outgoing stream;

w. fully condensing the partially condensed outgoing stream in the second condenser using a second external coolant stream to form a fully condensed outgoing stream; and y. pressurizing the fully condensed outgoing stream to a desired high pressure to form an outgoing stream, where the streams comprise at least one lower boiling component and at least one higher boiling component and the compositions of the streams are the same or different with the composition of the incoming stream and the outgoing stream being the same.

20. The method of claim 19, wherein the composition of the incoming stream or the outgoing stream is selected from the group consisting of an ammonia-water mixture, a mixture of two or more hydrocarbons, a mixture of two or more freons, and a mixture of hydrocarbons and freons.

21. The method of claim 19, wherein the composition of the incoming stream or the outgoing stream comprises a mixture of water and ammonia.

* * * * *